US005653361A

United States Patent [19]

Favre

[11] Patent Number: 5,653,361

[45] Date of Patent: Aug. 5, 1997

[54] DOUBLE DISPENSING RECEPTACLE WITH DEFORMABLE WALLS

[75] Inventor: Bernard Favre, Sceaux, France

[73] Assignee: LIR France, Chevilly-Larue, France

[21] Appl. No.: 511,600

[22] Filed: Aug. 4, 1995

[30] Foreign Application Priority Data

Aug. 5, 1994 [FR] France ..... 94 09759

[51] Int. Cl.[6] ..... B65D 37/00

[52] U.S. Cl. ..... 222/129; 222/212; 222/215

[58] Field of Search ..... 222/94, 107, 129, 222/206, 212, 215

[56] References Cited

U.S. PATENT DOCUMENTS

| | | | |
|---|---|---|---|
| 2,166,307 | 7/1939 | Libby | 222/94 |
| 3,347,420 | 10/1967 | Donoghue | 222/129 |
| 3,782,600 | 1/1974 | Columbus | 222/94 |
| 3,866,800 | 2/1975 | Schmitt | 222/94 |
| 4,984,715 | 1/1991 | Green | 222/129 |
| 5,114,044 | 5/1992 | Spanek, Jr. | 222/94 |
| 5,137,178 | 8/1992 | Stokes et al. | 222/94 |
| 5,223,245 | 6/1993 | Ibrahim et al. | 222/94 X |
| 5,252,312 | 10/1993 | Gentile et al. | 222/94 X |
| 5,269,441 | 12/1993 | O'Meara | 222/94 |

FOREIGN PATENT DOCUMENTS

| | | |
|---|---|---|
| 1209359 | 3/1960 | France . |
| 881740 | 11/1961 | United Kingdom . |

*Primary Examiner*—Andres Kashnikow
*Assistant Examiner*—Kenneth Bomberg
*Attorney, Agent, or Firm*—Young & Thompson

[57] ABSTRACT

Double dispensing receptacle with deformable walls comprising two compartments (4, 4') separated from each other and connected to a distributing head (8). The tubular body (1) of the receptacle has a substantially oval shape whose ends are formed by the two compartments (4, 4'). At least one free space (5) is provided between the compartments (4, 4'). The free space (5) deforms under the influence of manual pressure by escape of the air via an opening provided in the receptacle. The receptacle is made of an elastically deformable material, so that it resumes its original shape upon release of pressure, the outside air re-entering the free space through the opening in the receptacle. The compartments are circular in cross section and are spaced apart by the free space (5).

3 Claims, 1 Drawing Sheet

DOUBLE DISPENSING RECEPTACLE WITH DEFORMABLE WALLS

Figure 1:
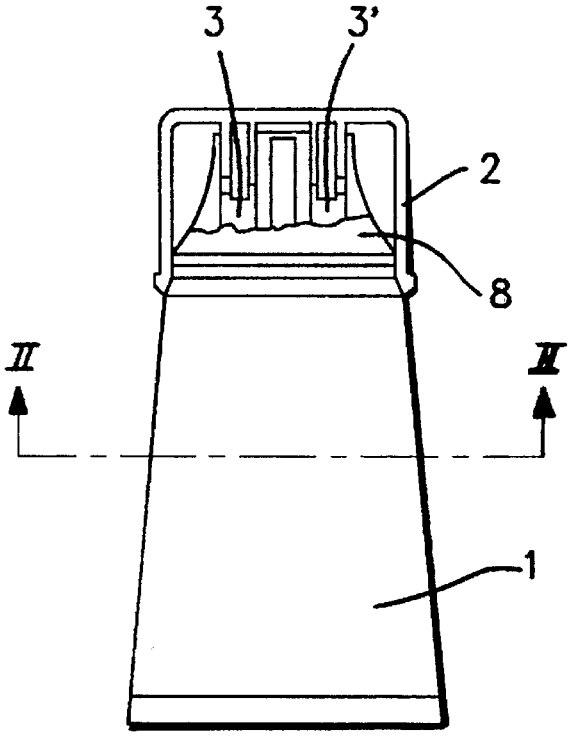

The present invention relates to a double dispensing receptacle with deformable walls, in particular a tube, to contain separately and to dispense simultaneously two liquid or fluid products.

For certain applications and particularly in the field of cosmetics, the use of different active principles within a same product is becoming more and more common. However, said active principles are not always mixable or storable once mixed. As a result, it is necessary to provide, for example within one tube, two compartments separately enclosing the two active principles so as to avoid their contact before their conjoint use.

In the case of a tube with deformable walls, in particular by manual pressure, the separation wall between the two internal compartments of the tube must also be able to be deformable under the influence of the exerted pressure. Thus, if this wall does not sufficiently deform, there is a risk of rupturing the separation wall and bringing the separate compartments into communication with each other.

French patent FR-B-2.627.463 provides a tubular receptacle with deformable walls comprising a longitudinal partition delimiting two separate compartments within the receptacle, the larger of a width equal to at least half the internal periphery of the body of the receptacle and connected in sealed fashion to the walls of said receptacle.

However, such an embodiment is not completely satisfactory. Thus, in the course of various manipulations and pressures to which the tubular receptacle is subjected, the securement of the partition on the walls can be affected and the sealed separation between the compartments is not ensured.

French patent FR-A-1.209.359 provides receptacles with multiple compartments and particularly an ampoule constituted of two twin symmetrical ampoules assembled by welding along their periphery or only at their ends. These ampoules are of a rigid or semi-rigid material and are designed to contain a product which, once opening of the ampoule is effected by cutting one of its ends, is totally used up.

Such an embodiment does not permit obtaining a satisfactory dispenser when this ampoule is used only to enclose predetermined measured quantities of product and, moreover, does not permit deformation of these walls so as to assist in dispensing.

To overcome these drawbacks, the invention provides a dispensing receptacle with deformable walls, particularly a tube, in which the seal between two separated compartments is completely ensured.

To this end, the invention consists in a dispensing receptacle with deformable walls, comprising two compartments separated from each other, characterized in that the tubular body of the receptacle has a substantially oval shape whose ends are formed by the two compartments, at least one free deformable space being provided between said compartments.

Preferably, the free space deforms under the influence of manual pressure by escape of the air via an opening provided in the receptacle such that, when the pressure is released, air re-enters the free space through this opening.

The space freed by evacuation of air during exertion of pressure is used by the two compartments which dispose therein their own elastic deformations, the cross section of the tubular body being preferably selected to accommodate said elastic deformations such that the internal walls of the two compartments may meet upon collapse. Thus, the space is such that the walls of the two compartments can touch only when said compartments are totally collapsed.

Preferably, the dispensing receptacle is of an elastically deformable material such that the free space can totally recover its original volume when the exerted pressure ceases. By the same token, the entire receptacle also retrieves its original shape.

According to one embodiment of the invention, there can be inserted into the free space between the two compartments a piece of elastic material which serves as an abutment between them when said compartments are pressed toward each other. There is thus avoided any contact between the two compartments and moreover this contributes to the return to original shape.

In a particularly preferred manner, the external surface comprised between the two compartments can be used for commercial or publicity messages.

Thus, in the case of receptacles for specimens, the invention permits obtaining a larger writing surface while offering the possibility of limiting the volume of the products offered.

Moreover, an esthetic effect connected to the presence of the free space can be obtained by using a translucent or semi-translucent material to produce the dispensing receptacle.

This type of double dispensing receptacle, in particular tubular, finds application in cosmetics but also in other fields such as particularly glues.

Figure 2:
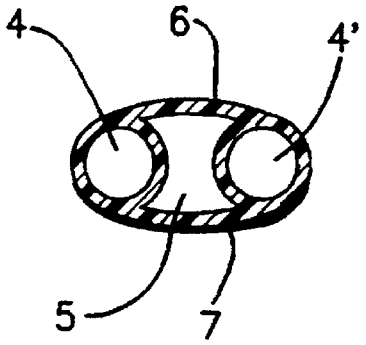

The invention will be better understood from a reading of the following description given with reference to the accompanying drawing, in which:

FIG. 1 is a longitudinal cross-sectional view of a tubular receptacle according to the invention, and, FIG. 2 is a cross-sectional view on the line II—II of FIG. 1.

The dispensing receptacle according to the invention comprises a tubular body 1 and a closure cap 2. In the tubular body are disposed two compartments 4, 4', preferably of circular cross section, located at the ends of the tubular body 1.

A free space 5 filled with air is created between the compartments 4 and 4' and the surfaces 6 and 7 of the tubular body 1.

The cross section of the tubular body 1 is such that, when a pressure is exerted on the walls of said tubular body 1, the air contained within the free space 5 is evacuated in part and the elastic deformations of the compartments 4 and 4' are received within the free space 5 freed from a portion of its air.

When the pressure ceases, the receptacle, constituted preferably of an elastically deformable material, recovers its shape by reintroduction of air into the free space 5.

At the upper portion of the tubular body 1 is connected a head 8 provided with outlet conduits 3 and 3' prolonging respectively the compartments 4 and 4', the assembly ensuring the mixed distribution of the products contained in said compartments 4 and 4'.

The inlet opening and the air outlet in the space 5 can be located on one of the surfaces 6 or 7 of the tubular body but preferably the head 8 can also comprise this opening.

I claim:

1. In a double dispensing receptacle with deformable walls comprising two compartments (4, 4') separated from each other and connected to a distributing head (8); the improvement wherein a tubular body (1) of the receptacle forms one of said deformable walls as a continuous outer wall having a substantially oval shape whose ends are occupied by the two compartments (4, 4'), at least one free space (5) being provided between said compartments (4, 4') within said continuous outer wall, into which free space the compartments can impinge when the compartments are deformed in the course of dispensing material therefrom.

2. The dispensing receptacle according to claim 1, which is made of an elastically deformable material, whereby said receptacle resumes a normal shape upon being released.

3. The dispensing receptacle according to claim 1, wherein said compartments have each a circular cross section.

* * * * *